US005844172A

United States Patent [19]

Cooper

[11] Patent Number: 5,844,172

[45] Date of Patent: Dec. 1, 1998

[54] INSULATOR FOR WIRE TERMINALS

[76] Inventor: David S. Cooper, 21 S. Oak Park Ave., Colfax, Iowa 50054

[21] Appl. No.: 865,613

[22] Filed: May 29, 1997

[51] Int. Cl.[6] ..... H01R 11/00

[52] U.S. Cl. ..... 174/138 F; 439/467

[58] Field of Search ..... 174/138 F, 135, 174/112, 93; 439/467, 687, 696, 906

[56] References Cited

U.S. PATENT DOCUMENTS

| | | | |
|---|---|---|---|
| 4,225,205 | 9/1980 | Sinclair et al. | 439/467 |
| 4,413,872 | 11/1983 | Rudy, Jr. et al. | 439/467 |
| 4,759,723 | 7/1988 | Siemon | 439/467 |
| 5,191,172 | 3/1993 | Garganese | 174/138 F |
| 5,439,759 | 8/1995 | Lippert et al. | 429/65 |

*Primary Examiner*—Bot L. Ledynh
*Assistant Examiner*—Joseph Waks

[57] ABSTRACT

An insulator for wire terminals for covering connectors at the ends of temporarily detached live electric wires includes an upper housing and a lower housing hingedly attached at one end. Each housing is structured to include a cavity and a semi-circular recess leading from the respective cavity to a side of the respective housing opposite the hinge. The insulator further includes a tab like grip for facilitating manipulation of the insulator and adhesive pads for holding the housings together.

4 Claims, 3 Drawing Sheets

INSULATOR FOR WIRE TERMINALS

BACKGROUND OF THE INVENTION

1. Field of the Invention

The present invention relates to insulating shield type devices and more particularly pertains to a new Insulator for Wire Terminals which provides a means of covering the connectors at the ends of temporarily detached live electric wires.

2. Description of the Prior Art

The use of insulating shield type devices is known in the prior art. More specifically, insulating shield type devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art insulating shield type devices include U.S. Pat. No. 4,929,195; U.S. Pat. No. 5,232,380; U.S. Pat. No. 268,926; U.S. Pat. No. 4,702,538; U.S. Pat. No. 4,824,377 and U.S. Pat. No. 4,820,201.

While these devices fulfill their respective, particular objectives and requirements, the aforementioned patents do not disclose a new Insulator for Wire Terminals. The inventive device includes an upper inner recessed means, a lower inner recessed means, an upper semi-circular recessed means, a lower semi-circular recessed means, a hinging means, an upper housing, a lower housing, a gripping means, and adhesive pads.

In these respects, the Insulator for Wire Terminals according to the present invention substantially departs from the conventional concepts and designs of the prior art, and in so doing provides an apparatus primarily developed for the purpose of providing a means of covering the connectors at the ends of temporarily detached live electric wires.

SUMMARY OF THE INVENTION

In view of the foregoing disadvantages inherent in the known types of insulating shield type devices now present in the prior art, the present invention provides a new Insulator for Wire Terminals construction wherein the same can be utilized for providing a means of covering the connectors at the ends of temporarily detached live electric wires.

The general purpose of the present invention, which will be described subsequently in greater detail, is to provide a new Insulator for Wire Terminals apparatus and method which has many of the advantages of the insulating shield type devices mentioned heretofore and many novel features that result in a new Insulator for Wire Terminals which is not anticipated, rendered obvious, suggested, or even implied by any of the prior art insulating shield type devices, either alone or in any combination thereof.

To attain this, the present invention generally comprises an upper inner recessed means, a lower inner recessed means, an upper semi-circular recessed means, a lower semi-circular recessed means, a hinging means, an upper housing, a lower housing, a gripping means, and adhesive pads.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Insulator for Wire Terminals apparatus and method which has many of the advantages of the insulating shield type devices mentioned heretofore and many novel features that result in a new Insulator for Wire Terminals which is not anticipated, rendered obvious, suggested, or even implied by any of the prior art insulating shield type devices, either alone or in any combination thereof.

It is another object of the present invention to provide a new Insulator for Wire Terminals which may be easily and efficiently manufactured and marketed.

It is a further object of the present invention to provide a new Insulator for Wire Terminals which is of a durable and reliable construction.

An even further object of the present invention is to provide a new Insulator for Wire Terminals which is susceptible of a low cost of manufacture with regard to both materials and labor, and which accordingly is then susceptible of low prices of sale to the consuming public, thereby making such Insulator for Wire Terminals economically available to the buying public.

Still yet another object of the present invention is to provide a new Insulator for Wire Terminals which provides in the apparatuses and methods of the prior art some of the advantages thereof, while simultaneously overcoming some of the disadvantages normally associated therewith.

Still another object of the present invention is to provide a new Insulator for Wire Terminals for providing a means of covering the connectors at the ends of temporarily detached live electric wires.

Yet another object of the present invention is to provide a new Insulator for Wire Terminals which includes an upper inner recessed means, a lower inner recessed means, an upper semi-circular recessed means, a lower semi-circular recessed means, a hinging means, an upper housing, a lower housing, a gripping means, and adhesive pads.

Still yet another object of the present invention is to provide a new Insulator for Wire Terminals that are made of a material that provides good insulation such as plastic.

Even still another object of the present invention is to provide a new Insulator for Wire Terminals that can be used as a means of covering the connectors found at the ends of temporarily detached live electric wires and can be produced in a range of sizes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
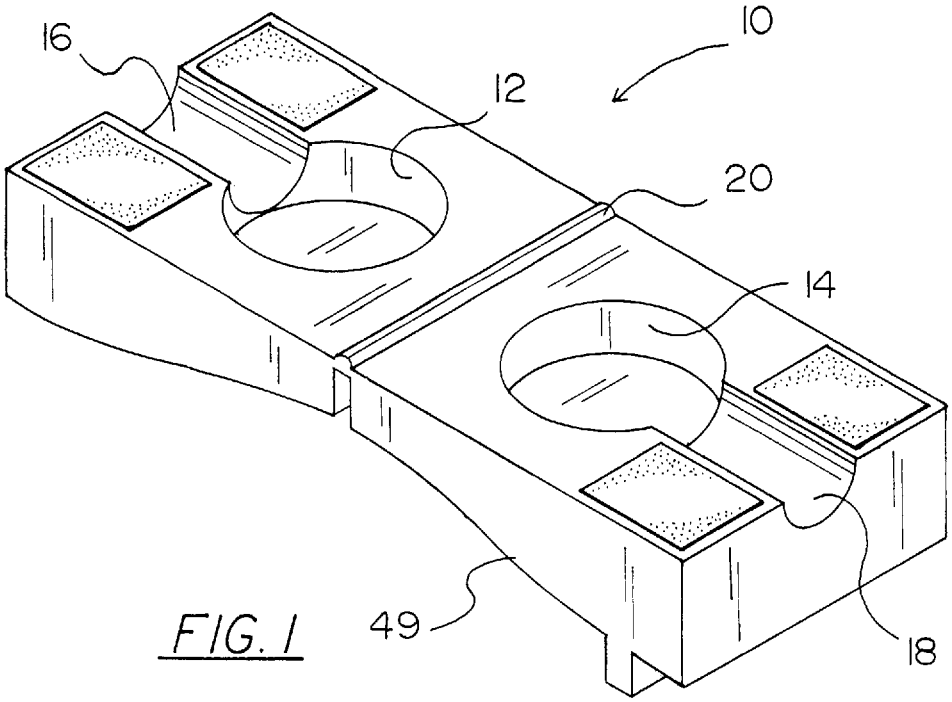
FIG. 1 is a right side perspective view of a new Insulator for Wire Terminals according to the present invention.
Figure 2:
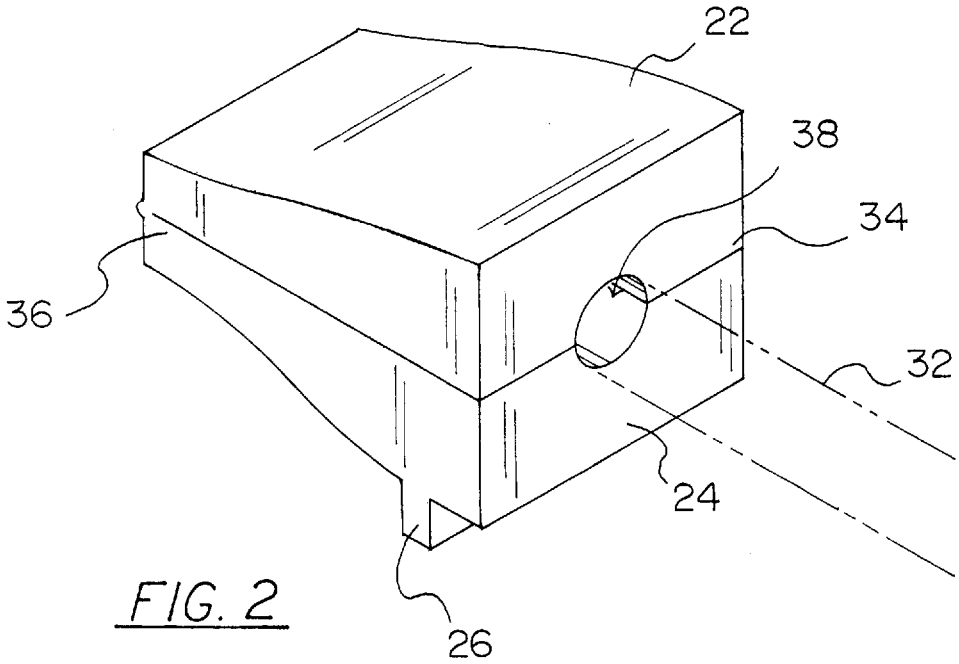
FIG. 2 is a side elevation view thereof.
Figure 3:
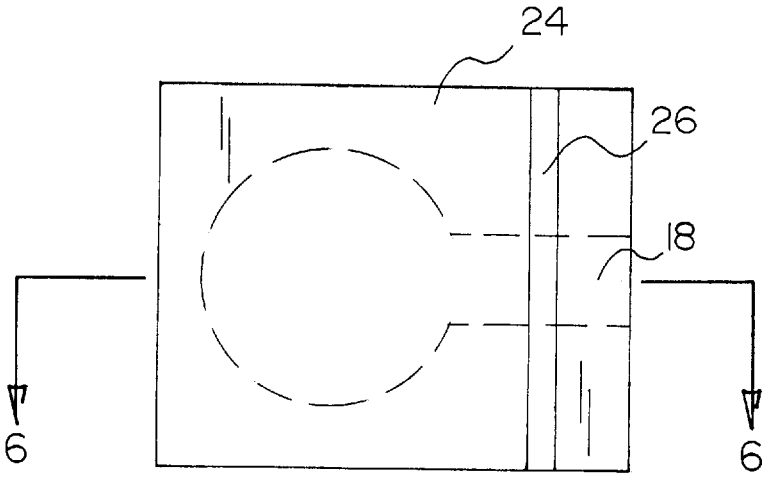
FIG. 3 is an exploded isometric illustration of the present invention.
Figure 4:
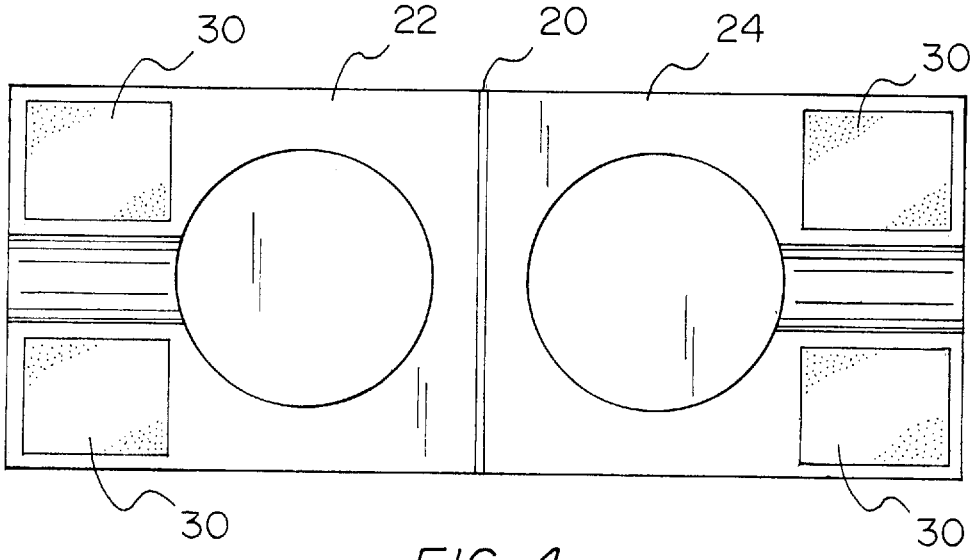
FIG. 4 is a top view of the invention.
Figure 5:
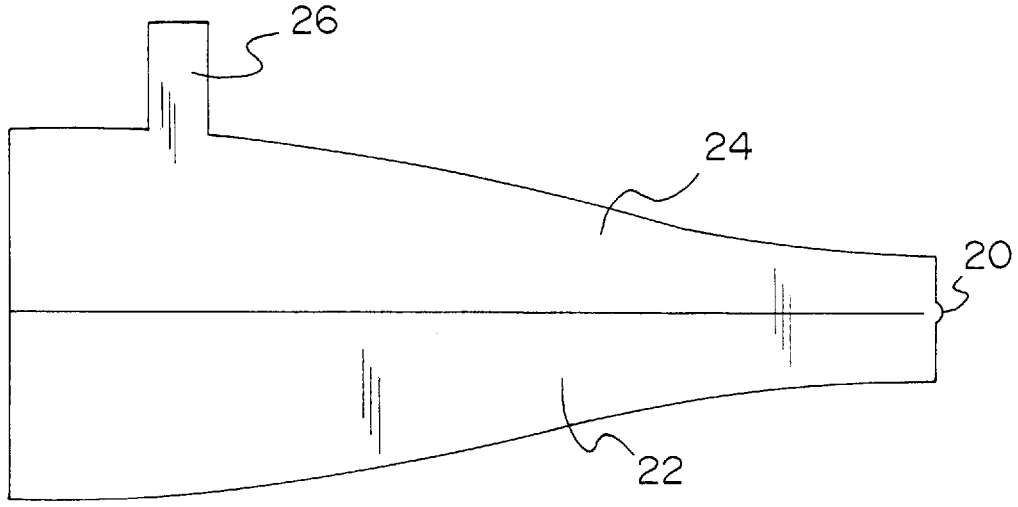
FIG. 5 is a left side view of the invention.
Figure 6:
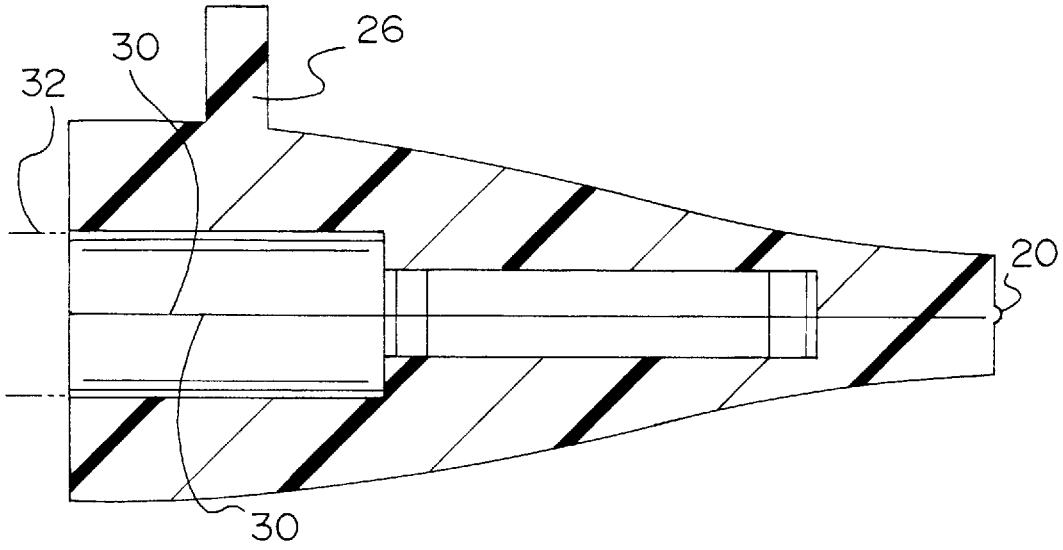
FIG. 6 is a cross sectional view taken along line 5—5 of FIG. 2.

With reference now to the drawings, and in particular to FIGS. 1 through 6 thereof, a new Insulator for Wire Terminals embodying the principles and concepts of the present invention and generally designated by the reference numeral 10 will be described.

More specifically, it will be noted that the Insulator for Wire Terminals 10 comprises an upper inner recessed means, a lower inner recessed means, an upper semi-circular recessed means, a lower semi-circular recessed means, a hinging means, an upper housing, a lower housing, a gripping means, and adhesive pads.

As best illustrated in FIGS. 1 through 6, it can be shown that the present invention teaches a novel and non-obvious Insulator for Wire Terminals.

The insulator for wire terminals includes an upper housing 22 pivotally connected to a lower housing 24 by a hinging means 20, the hinging means 20 being opposite a first side 34 of the insulator. The hinging means 20 can be metal hinge or it can be flexible portion of the Terminal 10 that allows for bending. A device of this kind can be formed from as an extruded part. The upper housing 22 is constructed of plastic and includes an upper housing cavity 12 and an upper housing semi-circular recessed portion 16 leading from said upper housing cavity 12 to an upper housing opening 38 opposite said hinging means 20. The lower housing 24 includes a lower housing cavity 14 and a lower housing semi-circular recessed portion 18 leading from said lower housing cavity 14 to a lower housing opening 38 opposite said hinging means 20. The first end 34 is just thick enough to fit over a flat conductive portion of a typical connector 32, wherein the second end 36 is sufficiently thick as to fit over an insulated connector end of a wire terminal 32. The gripping means 26 forms an elongated tab-like means to be used as a gripping surface when removing a unit from a terminal. The present invention 10 can be reused but preferably is a throw away device.

The lower housing 24 comprises plastic, wherein the Terminal 10 is sized for about an 18 to 20 gauge for about a 14 to 16 gauge wire, and for about a 10 to 12 gauge wire. Although the sizes of the Terminal 10 may be all of the same color, it is preferred that each sized is separately color coded, such as red for size 18 to 20 gauge, blue for 14 to 16 gauge and yellow for the 10 to 12 gauge wire. The invention 10 further includes at least four adhesive pads 30, wherein the four adhesive pads 30 comprises a low residue, low strength pressure sensitive adhesive. The adhesive pads 30 are provided to allow the upper housing 22 to remain intimately connected to the lower housing 24 yet being able to be easily opened.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An insulator for wire terminals comprising:

an upper housing pivotally connected to a lower housing;

a hinging means for coupling said upper housing to said lower housing;

wherein a first end is positioned opposite said hinging means; wherein said upper housing includes an upper housing cavity and an upper housing semi-circular recessed portion leading from said upper housing cavity to an upper housing opening opposite said hinging means;

said lower housing including a lower housing cavity and a lower housing semi-circular recessed portion leading from said lower housing cavity to a lower housing opening opposite said hinging means;

a gripping means adapted for facilitating gripping of the insulator during use, said gripping means being situated on an underside of said lower housing proximate said first end; and at least four adhesive pads, said adhesive pads being for coupling said upper housing and said lower housing together when folded along said hinging means.

2. The insulator for wire terminals of claim 1, wherein the four adhesive pads comprise a low residue, low strength pressure sensitive adhesive.

3. The insulator for wire terminals of claim 2, further comprising:

the gripping means including an elongated tab disposed from said lower housing.

4. An insulator for wire terminals comprising:

an upper housing pivotally connected to a lower housing;

a hinging means for coupling said upper housing to said lower housing;

wherein; a first end is positioned opposite said hinging means; wherein said upper housing includes an upper housing cavity and an upper housing semi-circular recessed portion leading from said upper housing cavity to an upper housing opening opposite said hinging means;

said lower housing including a lower housing cavity and a lower housing semi-circular recessed portion leading from said lower housing cavity to a lower housing opening opposite said hinging means;

a gripping means adapted for facilitating gripping of the insulator during use, said gripping means being situated on an underside of said lower housing proximate said first end; and wherein the gripping means includes an elongated tab disposed from said lower housing.

* * * * *